US006890043B2

(12) United States Patent
Haworth et al.

(10) Patent No.: US 6,890,043 B2
(45) **Date of Patent: *May 10, 2005**

(54) LOCK CAM WITH RESILIENT ARM FOR A CABINET LOCK

(75) Inventors: Richard G. Haworth, Holland, MI (US); Jayson J. Robinson, Stanwood, MI (US); Jeremy J. Jackson, Bitely, MI (US)

(73) Assignee: Haworth, Inc., Holland, MI (US)

( * ) Notice: Subject to any disclaimer, the term of this patent is extended or adjusted under 35 U.S.C. 154(b) by 72 days.

This patent is subject to a terminal disclaimer.

(21) Appl. No.: 10/327,672

(22) Filed: Dec. 20, 2002

(65) Prior Publication Data

US 2004/0119383 A1 Jun. 24, 2004

(51) Int. Cl.[7] ..... E05B 53/00

(52) U.S. Cl. ..... 312/218; 312/215; 312/220; 312/217

(58) Field of Search ..... 312/257.1, 215, 312/216, 217, 218, 219, 220, 221, 222, 107.5

(56) References Cited

U.S. PATENT DOCUMENTS

| | | | | |
|---|---|---|---|---|
| 912,570 A | | 2/1909 | Holland | |
| 1,109,086 A | | 9/1914 | Stuck | |
| 1,164,724 A | | 12/1915 | Kilmer | |
| 1,574,712 A | | 2/1926 | Stone | |
| 2,750,901 A | | 6/1956 | McClellan | |
| 2,793,927 A | | 5/1957 | Reitzel | |
| 2,810,616 A | | 10/1957 | McClellan | |
| 3,575,482 A | | 4/1971 | MacMaster et al. | |
| 3,597,036 A | | 8/1971 | Buffington | |
| 3,674,360 A | | 7/1972 | Ratner | |
| 3,870,387 A | | 3/1975 | Mortashed | |
| 4,168,103 A | | 9/1979 | Hagen | |
| 4,202,587 A | | 5/1980 | Wieland | |
| 4,303,287 A | * | 12/1981 | Taplin | 312/215 |
| 4,303,288 A | * | 12/1981 | Aschinger | 312/215 |
| 4,605,266 A | | 8/1986 | McKernan et al. | |
| 4,712,844 A | * | 12/1987 | Fry | 312/265 |
| 4,770,476 A | * | 9/1988 | Lakso | 312/220 |
| 5,249,443 A | | 10/1993 | Anderson | |
| 5,257,860 A | | 11/1993 | Slivon | |
| 5,303,994 A | * | 4/1994 | Elsholz | 312/221 |
| 5,385,039 A | | 1/1995 | Feldpausch et al. | |
| 5,427,445 A | * | 6/1995 | Mitchell | 312/221 |
| 5,678,437 A | | 10/1997 | Walla | |
| 5,871,263 A | * | 2/1999 | Johnston et al. | 312/217 |
| 6,018,969 A | | 2/2000 | Haseley et al. | |
| 6,497,462 B2 | * | 12/2002 | Jackson | 312/215 |

FOREIGN PATENT DOCUMENTS

| | | |
|---|---|---|
| FR | 2 583 813 | 12/1986 |

* cited by examiner

*Primary Examiner*—Anthony D. Barfield
*Assistant Examiner*—Erika Garrett
(74) *Attorney, Agent, or Firm*—Flynn, Thiel, Boutell & Tanis, P.C.

(57) ABSTRACT

An upright storage cabinet has a lock assembly which operates a vertically movable lock bar to simultaneously lock all drawers of the cabinet. The lock assembly includes a rotatable cam body which has a resiliently deflectable cam that projects radially therefrom. The cam body is rotatable between a locked position wherein the cam rotates a drive element to vertically displace the lock bar into engagement with the drawers, and an unlocked position wherein the cam allows the drive shaft to return to an initial position which disengages the lock bar from the drawers. The cam generates a driving force on the drive shaft during rotation of the cam body and is also resiliently deflectable to accommodate dimensional variations which varies the radial position of the drive shaft relative to the drive element.

24 Claims, 9 Drawing Sheets

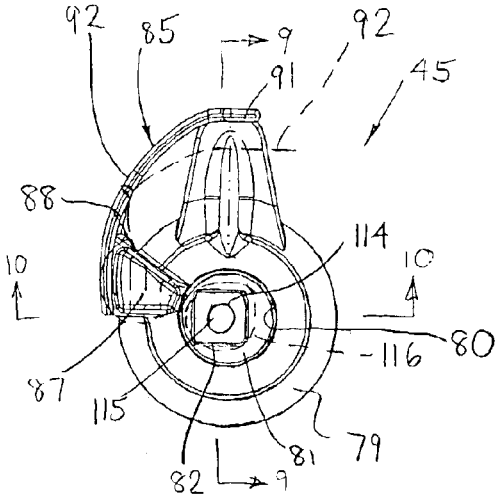
FIG. 8
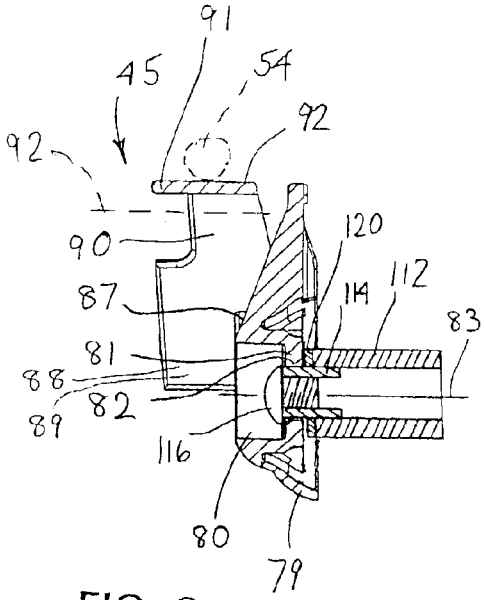
FIG. 9
FIG. 7
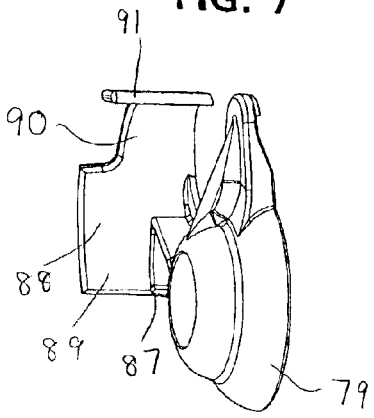
FIG. 10
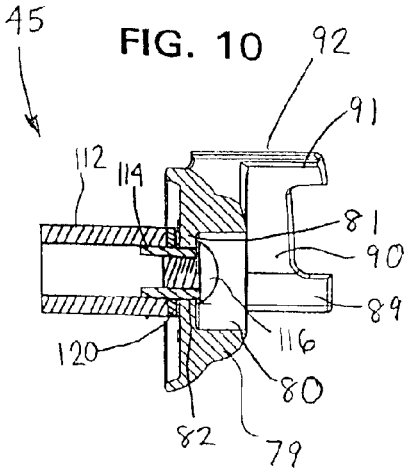

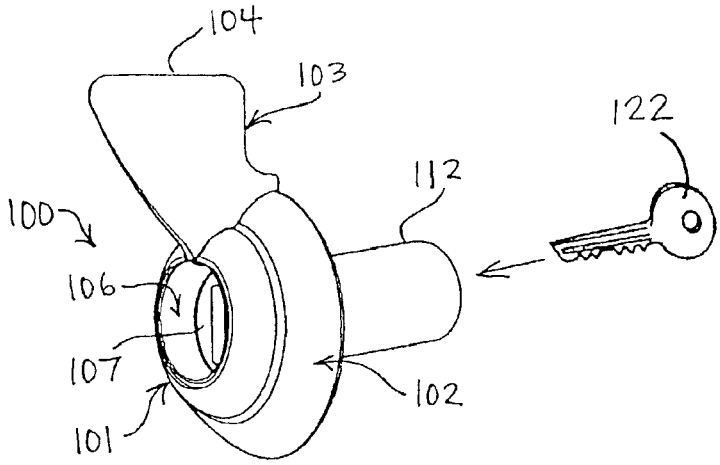
FIG. 15 (PRIOR ART)
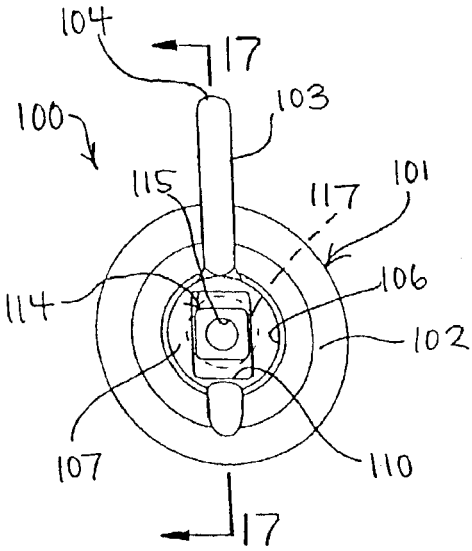
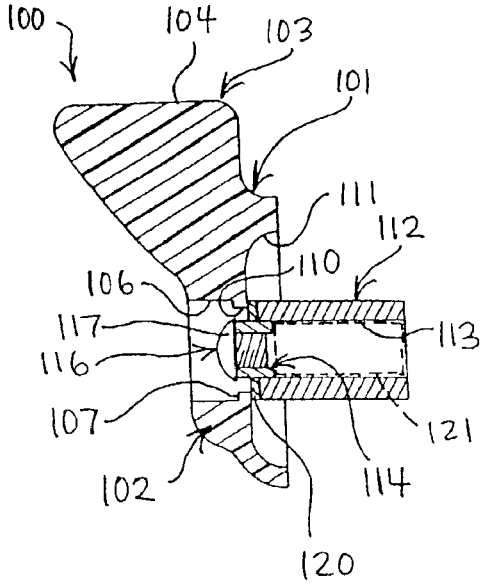
FIG. 16 (PRIOR ART) FIG. 17 (PRIOR ART)

LOCK CAM WITH RESILIENT ARM FOR A CABINET LOCK

FIELD OF THE INVENTION

This invention relates to an upright storage cabinet and more particularly, to an upright storage cabinet having a rotatable lock cam which is rotated to actuate a locking mechanism for locking drawers of the cabinet.

BACKGROUND OF THE INVENTION

Upright storage cabinets used in offices and similar environments conventionally include an upright hollow cabinet housing which is open at the front and receives one or more file drawers in a vertically stacked arrangement. Such cabinets are well known and typically include a locking mechanism which securely locks each drawer in a closed position.

These locking mechanisms often employ a key-operated lock device which is mounted on a drawer so as to be accessible from a front thereof. The lock device drives an intermediate linkage in the housing that controls vertical movement of a lock bar also supported in the housing. The lock bar cooperates with the individual drawers so as to simultaneously lock the drawers in the closed position when in a locking position and release said drawers when the lock bar is moved vertically to a release position.

Some known cabinets have locking mechanisms which include a lock cam on the lock device which is rotated to drive the intermediate linkage and vertically manipulate the lock bar to move the lock bar between the locking position and the release position. One example of such a cabinet and locking mechanism is the commercially available PREMISE® pedestal storage unit sold by the assignee of the present invention having a family code number of FS49DPFN.

The lock cam of the PREMISE® pedestal unit as illustrated in FIGS. 15–17 includes a lock assembly 100 which is mounted on the front wall of a topmost drawer. The lock assembly 100 includes a lock cam 101 having a generally hemispherically-shaped main body 102 which main body 102 includes a thin-shaped rigid cam portion 103 which projects radially outwardly from an outer surface of the main body 102 and terminates in a straight edge 104 at the distal end thereof. On a rearward facing side of the main body 102, a circular opening 106 is defined therein which projects forwardly into the main body 102 and terminates at a flat base wall 107. As shown in FIG. 16, the base wall 107 includes a vertically-elongate rectangular slot 110 which opens into a generally circular recess 111 which said recess 111 is defined in the frontward facing side of the main body 102.

The lock assembly 100 additionally includes a cylindrically shaped lock shell 112 which is non-rotatably mounted on the front wall of the cabinet drawer. The lock shell 112 defines a receptacle 113 which opens forwardly and is adapted to receive a plug-type actuator 121 (illustrated in phantom outline in FIG. 17). The actuator 121 is a key-type actuator which is operated by a key 122 (FIG. 15) to lock and unlock the lock assembly 100 through rotation of the lock cam 103.

The lock assembly 100 further includes a generally rectangular insert or lug 114 that is mounted to said actuator for rotation within the lock shell 112. The lug 114 includes an internally threaded hole 115 for receiving a pinch bolt or screw 116 which said screw 116 is engaged with the threaded hole 115 to fasten the lock cam 103 to the lock shell 112. In this regard, the screw head 117 is located within the cam hole 106 on the rearward side of the cam base wall 107 such that the screw head 117 clamps the base wall 107 along the longitudinal edges of the rectangular slot 110. The screw 116 thereby fixes the cam member 101 on the lug 114 and due to the rectangular shape of the lug 114, the cam 103 rotates in unison with the lug 114.

More particularly, the lug 114 includes an annular plate 120 which is non-rotatably fixed to lug 114 and cooperates with the lock shell 112 to prevent rotation of the lug 114 relative to the lock shell 112. In this regard, the plate 120 includes a notch on the periphery thereof which defines a pair of shoulders (not shown) which are circumferentially spaced apart from one another and cooperate with a corresponding stop (not shown) on the rearmost end of the lock shell 112.

Thus, when locking of the drawers is desirable, the key 122 is inserted into the actuator 120 and turned which thereby rotates the lug 114 and associated lock cam 101 between locked and unlocked positions which positions are defined by the shoulders of plate 120 with the stop on the lock shell 112. Rotation of the cam 101 causes the edge 104 thereof to make contact with a horizontal drive element or shaft which extends along the upper frontmost edge of the cabinet housing. Rotation of the drive element by cam portion 103 in turn raises a vertical locking bar oriented along a side wall of the cabinet. The vertical locking bar cooperates with the individual drawers to lock same in the closed position or release the drawers for opening thereof by vertical displacement of the locking bar.

Since the lug 114 may be slid vertically and thereby adjusted within the vertically elongate slot of the cam 101, the cam 101 tends to undergo "creep" or undesirable sliding within the slot 110 over a period of time. That is, repeated use of the lock assembly 100, movement of the cabinet, etc., can cause the cam 101 to shift longitudinally within the slot 110 from its original installed position. This shifting of the cam member 103 often results in a misalignment of the cam 103 relative to the drive element. Such creep of the cam body 101 from this installed position typically causes malfunctioning of the lock assembly 100 which in turn necessitates time consuming and costly readjustment of the position of the cam body 101.

It is an object of the present invention to overcome the disadvantages associated with the lock assembly 100 and undesirable creep or shifting of the cam body 101 referenced above. The invention relates to an improved lock assembly which has a cam body that is fixed on said lug 114 which eliminates undesirable creep or shifting of the cam body. To accommodate changes in the relative distance between the cam body and a horizontal drive element which differences may result from variations in manufacturing tolerances, wear or the like, the cam body includes a resilient cam projecting radially outwardly therefrom. The cam is resiliently deflectable radially inwardly which automatically compensates for manufacturing tolerances and wear without any adjustments being required in the connection of the cam body with the lug on the lock assembly.

Other objects and purposes of the invention, and variations thereof, will be apparent upon reading the following specification and inspecting the accompanying drawings.

BRIEF DESCRIPTION OF THE DRAWINGS

FIG. 7 is an enlarged rear perspective view of a cam body of a cam lock assembly;

FIG. 8 is an enlarged rear view of the cam body of FIG. 7;

FIG. 9 is a cross-sectional right side view taken generally along line 9—9 in FIG. 8 with the cam rotated to an active position;

FIG. 10 is an enlarged cross-sectional left side view taken generally along line 10—10 of FIG. 8 illustrating the cam rotated to an inactive position;

FIG. 15 is an enlarged rear perspective view of the cam lock assembly of the PREMISE® pedestal unit;

FIG. 16 is an enlarged rear view of the cam lock assembly of FIG. 15; and FIG. 17 is an enlarged cross-sectional view taken generally along line 17—17 in FIG. 16.

Figure 1:
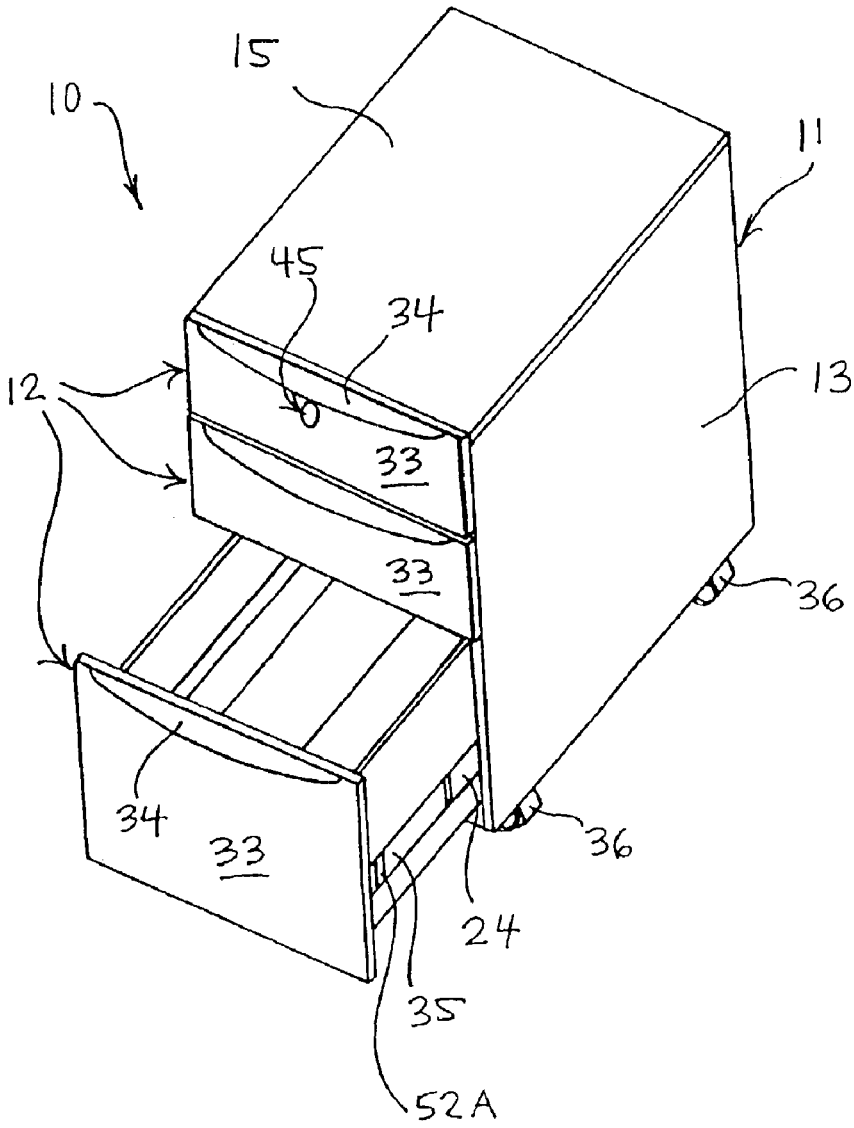
FIG. 1 is a front perspective view of an upright storage cabinet according to the invention with one drawer in an open position.

Certain terminology will be used in the following description for convenience in reference only, and will not be limiting. For example, the words "upwardly", "downwardly", "rightwardly" and "leftwardly" will refer to directions in the drawings to which reference is made. Further, the words "frontwardly" and "rearwardly" will respectively refer to the side of the storage cabinet which normally faces the user and the side of the cabinet which normally faces away from the user. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Figure 2:
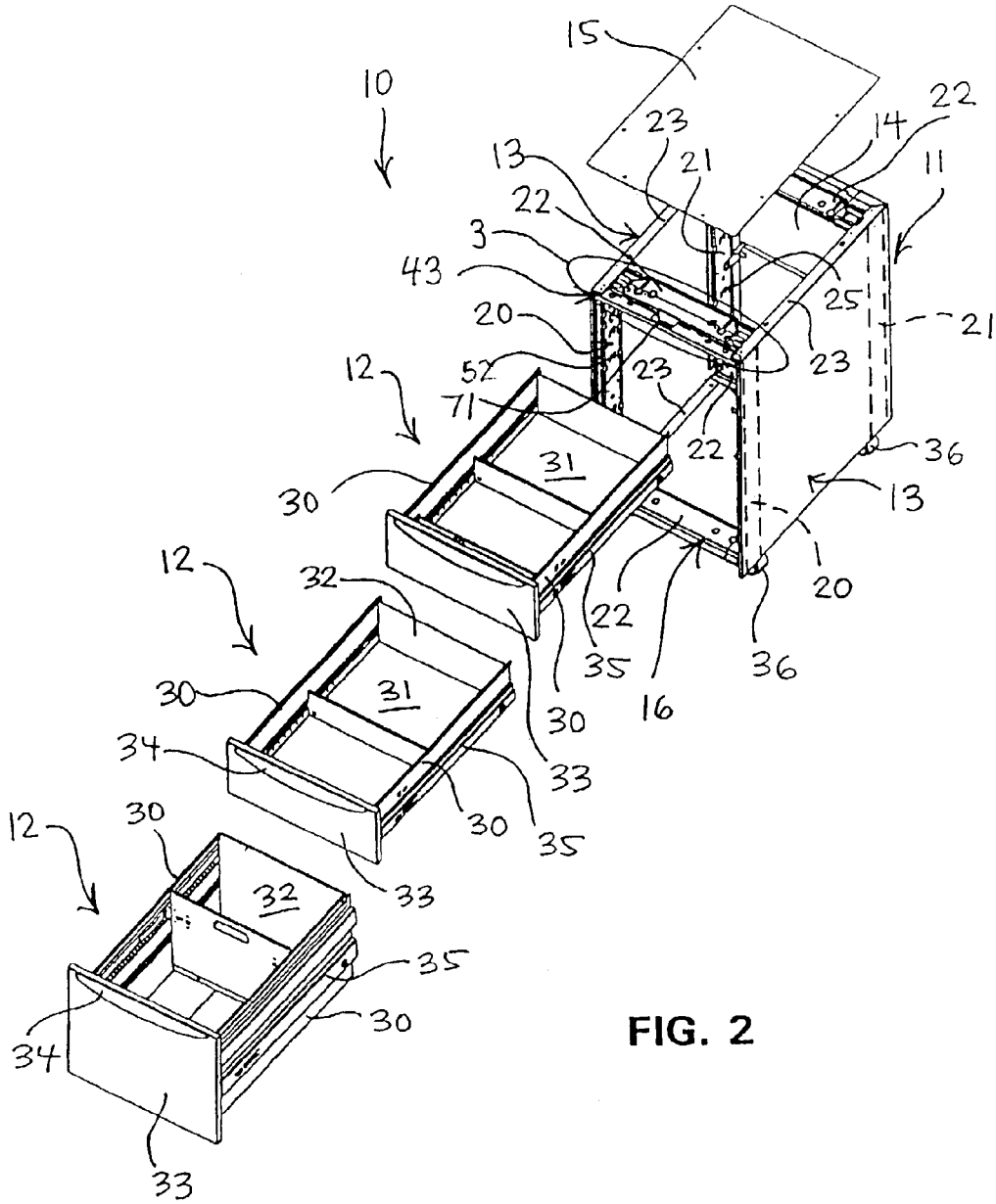
FIG. 2 is an exploded perspective view of the storage cabinet illustrated with the drawers and top wall of the cabinet removed.

FIG. 1 illustrates an upright storage cabinet 10 according to the invention. The storage cabinet 10 includes a box-like cabinet housing or enclosure 11 that has an open front side, and a plurality of slidable drawers 12 which are slidably received through the open front side of the cabinet 10. Referring to FIG. 2, the cabinet housing 11 is generally formed from a pair of identical right and left side walls 13, a back wall 14, and a top wall 15. The side walls 13, back wall 14, and top wall 15 are supported on an open, box-like frame 16 (FIG. 2).

Frame 16 includes a pair of horizontally-spaced and generally parallel upright front frame members 20 and a pair of horizontally-spaced and generally parallel upright rear frame members 21. The respective front frame members 20 are connected to one another by upper and lower vertically spaced and generally parallel horizontal frame members 22. The rear frame members 21 are interconnected to one another in a similar manner. In the illustrated embodiment, the adjacent pairs of front and rear upright frame members 20 and 21 are fixed to the inner sides of the respective right and left side walls 13. The horizontal frame members 22 extend transversely between the right and left side walls 13 and are vertically positioned with respect thereto via flanges 23 formed on the upper and lower edges of side walls 13.

To mount the drawers 12 within the cabinet 10, a plurality of elongate drawer slides 24 (not shown in FIG. 2, but see FIG. 1) are mounted along each of the side walls 13 so that the slides 24 extend horizontally between the front and rear upright frame members 20 and 21. For this purpose, the respective frame members 20 and 21 each define therein a plurality of connector tabs 25 which are adapted to engage the respective drawer slides 24.

Each of the drawers 12 includes a pair of identical side walls 30, a bottom wall 31, a back wall 32, and a front wall 33 which mounts thereon a drawer pull 34. The respective side walls 30 of each drawer 12 define outwardly projecting, generally horizontally oriented reinforcing channels 35 which seat on the respective opposed drawer slides 24 mounted on the right and left side walls 13 of the cabinet 10. In this regard, channels 35 define pockets and tabs therein which snap lockingly engage the drawer slide 24 so as to prevent dislodgement of the drawer 12 therefrom. The mounting of drawer slides 24 on side walls 13 as mentioned above, as well as the supporting of the drawers 12 on the opposed pairs of slides 24 by pockets and tabs, are conventional and thus a more detailed description is not believed necessary.

As shown in FIGS. 1 and 2, front and rear pairs of castors 36 are mounted to the respective front and rear lower horizontal frame members 22 to enable easy movement of the storage cabinet 10 to a desired location.

The storage cabinet 10 is provided with a locking arrangement 40 (FIG. 3) which permits simultaneous locking of all of the cabinet drawers 12 as is conventional with storage arrangements of this type. The locking arrangement 40 generally includes rigid vertical and horizontal locking bars or elements 41 and 42, a plate-like cross member 43 which defines a guide channel 44 for the horizontal locking element 42, and a cam lock assembly 45. In the illustrated embodiment, the cam lock assembly 45 is mounted on the rearwardly facing side of the front wall 33 of the uppermost drawer 12.

Figure 3:
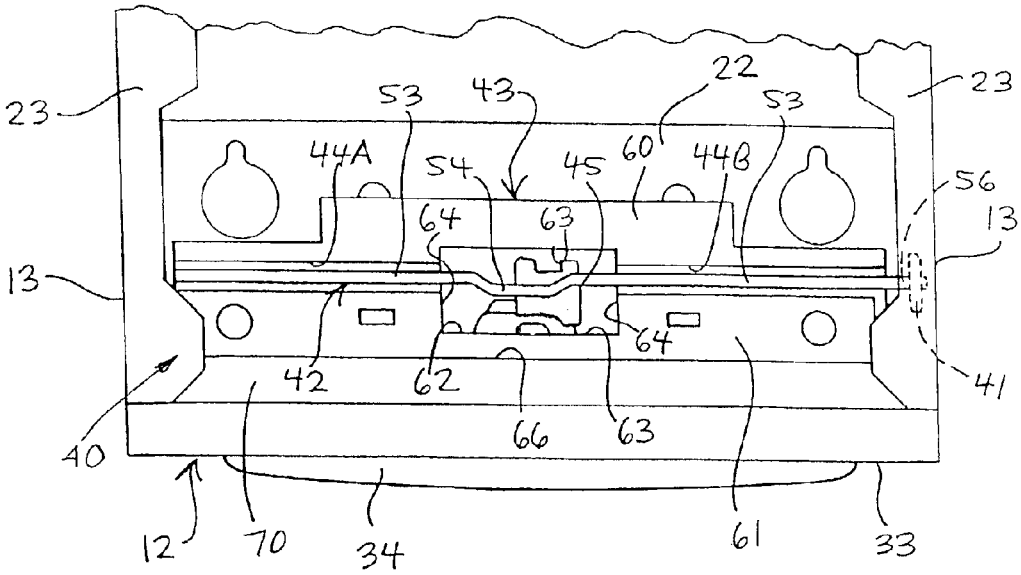
FIG. 3 is a fragmentary enlarged overhead view of the storage cabinet of FIG. 2 illustrating a cam body cooperating with a horizontal drive shaft or element.
Figure 4:
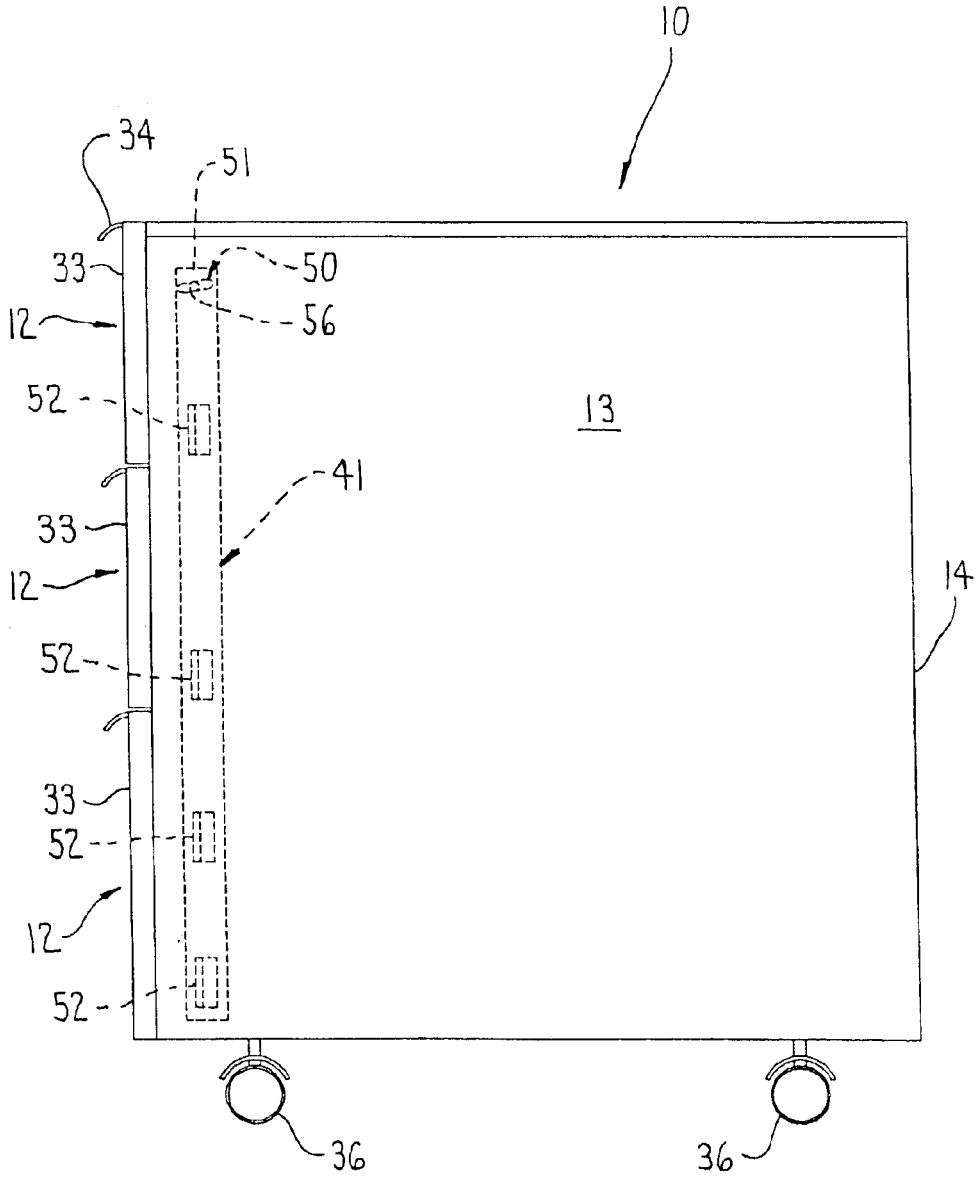
FIG. 4 is an enlarged diagrammatical side view of the storage cabinet illustrating a vertical lock bar in broken lines.

As shown in FIGS. 3 and 4, the vertical locking bar 41 is mounted inside the cabinet 10 generally along the front edge of the right side wall 13. In the illustrated embodiment, the locking bar 41 is disposed between the right front frame member 20 and the right side wall 13 of the housing 11. The locking bar 41 is mounted so that same is horizontally fixed, but vertically slidably movable between a locked position wherein the bar 41 is positioned in its uppermost position relative to side wall 13, and an unlocked position wherein the bar 41 is in its lowermost position relative to side wall 13. The locking bar 41 is vertically elongate and defines therein a horizontally elongate slot 50 which is disposed closely adjacent an uppermost horizontal edge 51 thereof. The slot 50 is oriented at a slight angle relative to the horizontal, and in this regard angles upwardly as same projects in a front-to-back direction of the cabinet 10.

The locking bar 41 includes a plurality of tabs or flanges 52 (FIG. 2) which project inwardly towards the interior of the cabinet 10 in a generally perpendicular manner relative to side wall 13. These flanges 52 can be formed by cut-outs in which the cut metal material is then bent inwardly to form the flanges 52. The flanges 52 are vertically spaced from one another along the vertical length of the bar 41, and are located in positions which allow same to cooperate with correspondingly located notches 52A (FIG. 1) defined in the individual drawers 12 to lock same within the cabinet 10.

Figure 5:
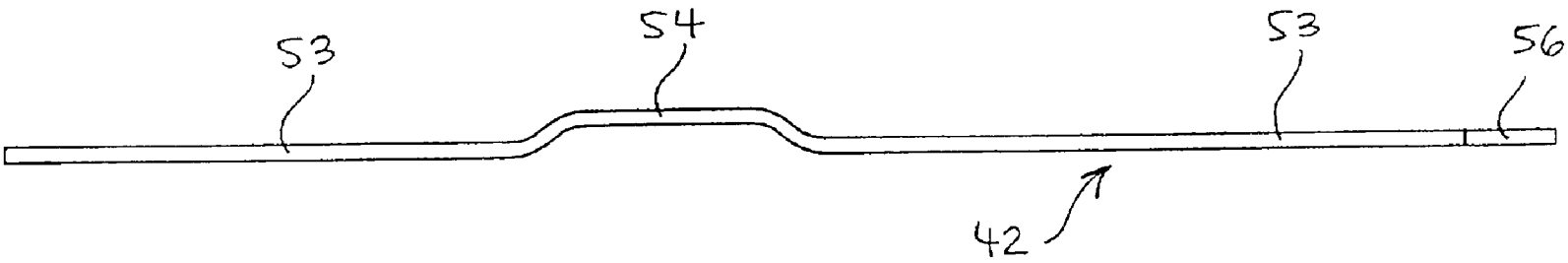
FIG. 5 is an enlarged side view of the horizontal drive element in isolation.
Figure 6:
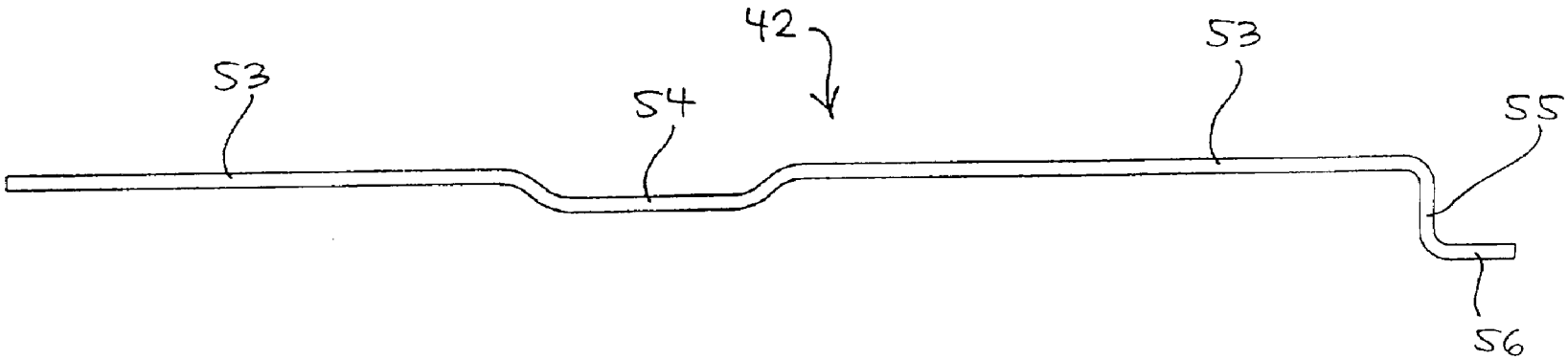
FIG. 6 is a view of the horizontal drive element rotated approximately 90° from the position illustrated in FIG. 5.
Figure 13:
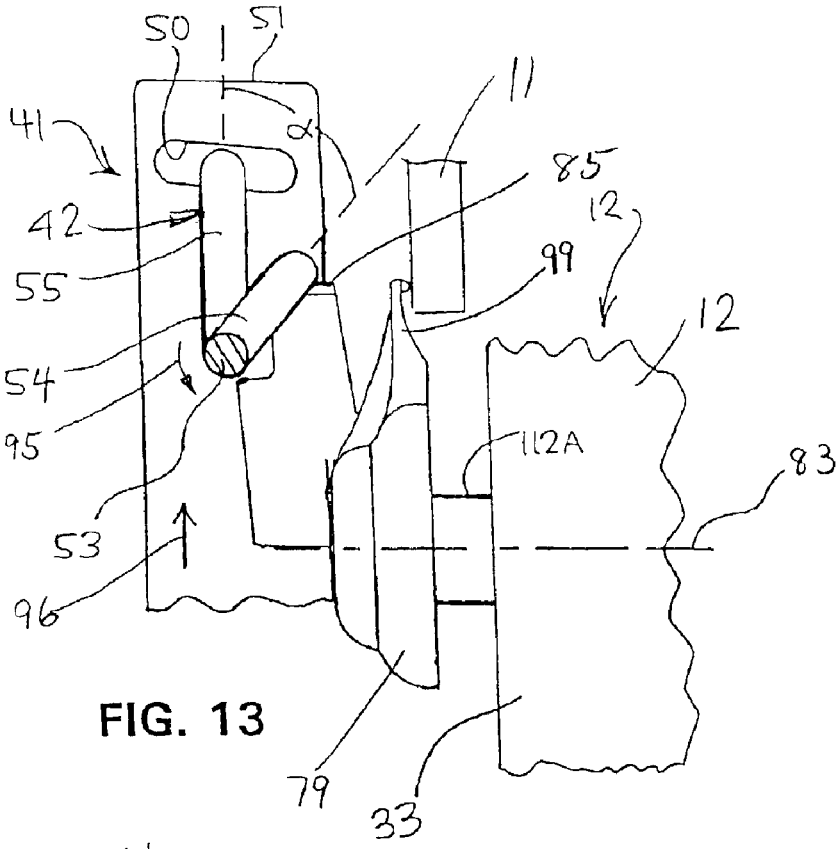
FIG. 13 is an enlarged fragmentary diagrammatical side view of the lock assembly with the cam body in the active position.
Figure 14:
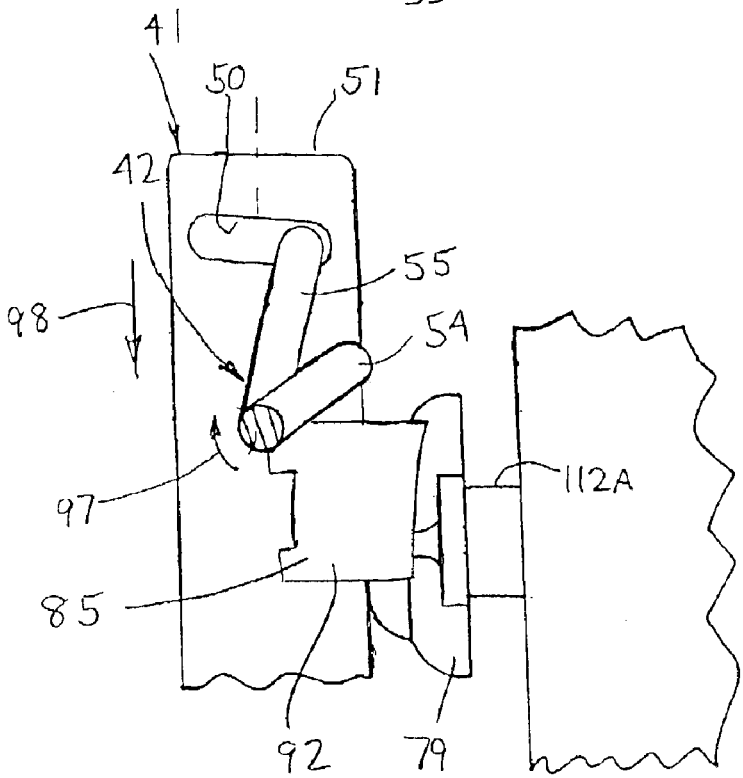
FIG. 14 is an enlarged fragmentary diagrammatical side view similar to FIG. 13, but illustrating the cam body in the inactive position.

With reference to FIGS. 5 and 6, the rod-like horizontal locking element 42 more specifically serves as a movable drive element which drives movement of the vertical locking bar 41. The drive element 42 includes a pair of straight portions 53 which are disposed on opposite sides of a generally centrally located actuator portion or lever 54 which is offset relative to straight portions 53. The rightmost end of drive element 42 is bent so as to form a drive lever defined by a first leg or lever 55 which projects generally vertically relative to the right portion 53 and a second leg 56 which is joined to an outermost end of first leg 55 and projects generally horizontally therefrom so that the first and second legs 55 and 56 are perpendicular relative to one another. As discussed further below, the terminal end of the second leg 56 is engaged within the slot 50 of the vertical locking bar 41 mounted within cabinet 10. As shown in FIGS. 13 and 14, the vertical first leg 55 of element 42 and the actuator portion or lever 54 are disposed at an angle $\alpha$ relative to one another, and in the illustrated embodiment, angle $\alpha$ has a value of about 45°.

Figure 11:
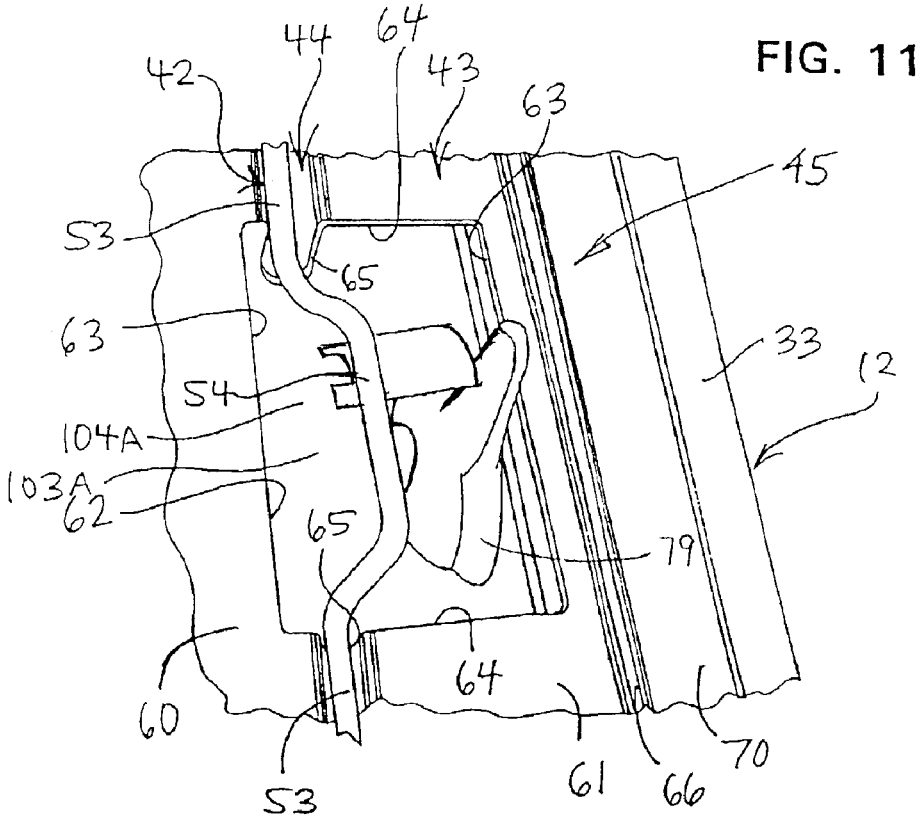
FIG. 11 is an enlarged fragmentary overhead view of the locking mechanism with the cam body biasing a drive element to a raised locked position.
Figure 12:
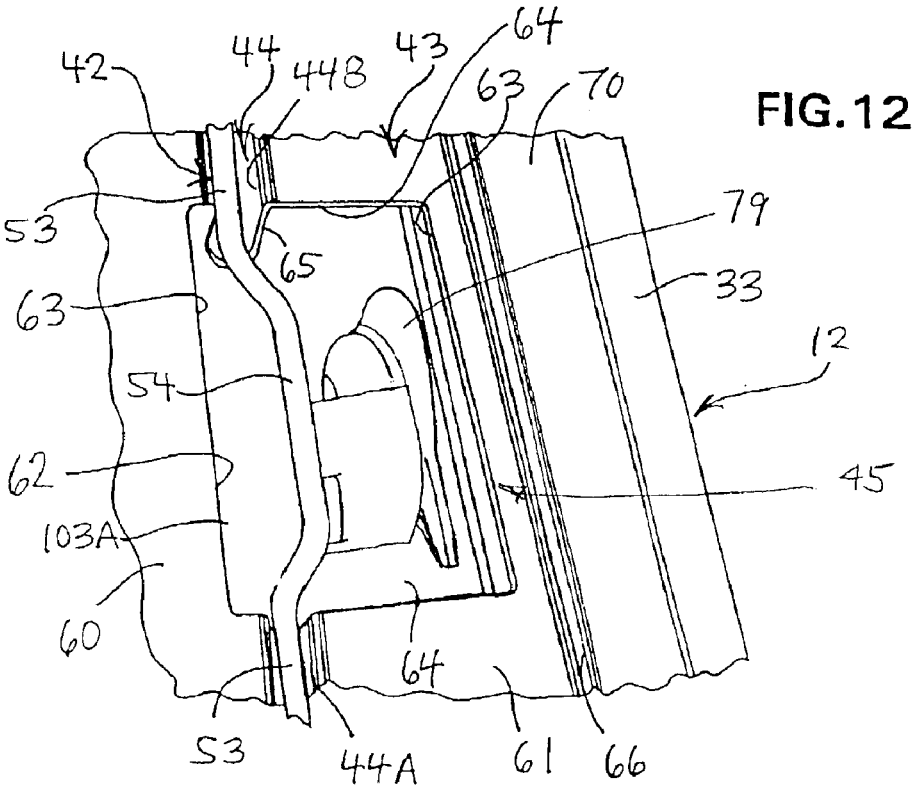
FIG. 12 is an enlarged fragmentary view similar to FIG. 11, but illustrating the cam body in the lower inactive position and the drive element in an unlocked position.

The horizontal drive element 42 is journalled in the guide channel 44 of cross member 43. With reference to FIGS. 3, 11 and 12, cross member 43 is superimposed upon and fixed to the frontmost and upper horizontal frame member 22. Cross member 43 in the illustrated embodiment has a pair of flat, plate-like and coplanar parts 60 and 61 disposed on opposite sides of guide channel 44.

A rectangular window or cut-out 62 is defined within cross member 43 and interrupts and divides the guide channel 44 into two longitudinally aligned channel parts 44A and 44B. Window 62 has a pair of straight longitudinal edges 63 which are parallel to, and spaced a short distance outwardly from guide channel 44, and a pair of straight transverse edges 64 which extend between the edges 63 and respectively form inner terminal U-shaped end edges 65 of guide channel 44. Guide channel 44 thus has an upwardly-opening U-shape when viewed in transverse cross-section, and projects downwardly from the horizontal plane occupied by parts 60 and 61.

Cross member 43 is further defined by a wall or shoulder 66 which projects vertically upwardly from frontmost part 61, and a frontwardly oriented flat portion 70 which projects horizontally forwardly from the uppermost end of wall 66. A flange 71 (FIG. 2) projects downwardly from a longitudinal forward edge of portion 70 and is disposed closely adjacent the front wall 33 of the drawer 30 when same is in the closed position.

Horizontal drive element 42 is positioned within guide channel 44 so that the actuator portion 54 thereof is disposed within window 62 to allow same to move freely between the locked and unlocked positions, and the straight rod-like portions 53 of element 42 are seated upon the upwardly facing lowermost surfaces of the channel portions 44A and 44B. Thus, with the second leg 56 of the element 42 engaged within the slot 50 of vertical locking bar 41, the channel 44 serves to journal the drive element 42 so that same can be rotated between locked and unlocked positions or in other words, active and inactive positions.

The above-discussed construction of the storage cabinet 10 is conventional, and the advantageous construction of the cam lock assembly 45 according to the invention will now be described. The cam lock assembly 45 is similar in construction to the cam lock assembly 100 discussed above, and therefore some of the same reference numbers to depict identical or similar components.

With reference to FIGS. 7–9, the cam lock assembly 45 according to the invention includes a cam member or body 79 similar to cam member 101 discussed above, which said cam body 79 mounts to a lug arrangement of a lock. In particular, the lock assembly 45 includes a lock shell 112 which is mounted on the front wall of a cabinet drawer 12. The lock shell 112 supports the key-type actuator 121 and has a lug 114 supported at an inner end thereof by the annular lug plate 120. The cam body 79 is mounted on the lug 114 by the fastener screw 116 which said screw 116 is threaded into the lug hole 115 (FIG. 8). As such, rotation of a key 122 in the plug-type actuator 121 which is adapted to fit within the shell 112 effects a corresponding rotation of the cam body 79.

More particularly as to the cam body 79, this cam body 79 has a one-piece plastic construction which is adapted to accommodate variations in dimensional tolerances in the cam body 79, the lock assembly 45 and the drive element 42 in addition to other components of the overall storage cabinet 10.

In this regard, the cam body 79 has a circular opening or bore 80 which terminates at a flat base wall 81. The base wall 81 includes a substantially square or rectangular opening 82 which has a size and shape that corresponds to the lug 114 so as to slidably receive the end of the lug 114 in close fitting engagement within the opening 82. When the cam body 79 is fitted on the lug 114, the cam body 79 and lug 114 thereby rotate in unison about a rotation axis 83 and the cam body 79 is thereby non-movable or stationary relative to the rotation axis 83. Due to the close fitting engagement of the lug 114 and the opening 82, undesirable creep or slippage which occurs with the cam member 101 of the prior art arrangement is avoided in the inventive cam body 79.

To effect rotation of the drive member 42 about the rod sections 53, the cam body 79 includes a radially projecting cam 85 which is adapted to contact the lever 54 (FIGS. 11 and 12) of the drive member 42 and thereby move the lever 54 vertically upwardly and cause rotation of the drive member 42. The cam body 79 is molded with a support block 87 on the outer periphery thereof which support block 87 is molded integrally with a generally flat, arcuate cam plate 88. The cam plate 88 has an inner end 89 supported on the support block 87 in cantilevered relation and transitions circumferentially into a narrow section 90 and a wider distal end section 91. The plate-like sections 89–91 extend continuously and define an arcuate camming surface 92 which generally extends circumferentially and faces radially outwardly away from the rotation axis 83. Normally, the cam plate 88 is in an undeflected condition as illustrated in FIG. 8 although the cam plate 88 also is resiliently deflectable radially inwardly as can be seen by the camming surface 92 illustrated generally in phantom outline in FIGS. 8 and 9.

During rotation of the cam body 79, the cam 85 rotates circumferentially between the active position illustrated in FIG. 8 and the sidewardly projecting initial or inactive position illustrated in FIG. 10. More particularly as to FIGS. 13 and 14, the cam body 79 when in the active position of FIG. 13 has the cam 85 directly contacting the lever 54 of the drive element 42 which thereby rotates the drive element 42 as generally illustrated by reference arrow 95. Rotation in the direction of arrow 95 causes a corresponding vertical movement of the locking bar 41 as indicated by reference arrow 96.

As the cam body 79 is rotated back to the inactive position of FIG. 14, the cam 85 projects sidewardly and allows lowering of the lever 54 which causes a return rotation of the drive element 42 in the direction of reference arrow 97. This rotation in the direction of reference arrow 97 causes a lowering of the locking bar 41 in the direction of reference arrow 98. It will be understood that the cam 85 may remain in contact with the lever 54 in the inactive position and have a reduced amount of deflection as compared to the amount of deflection occurring in the active position.

Since the relative vertical distance between the lever 54 and the rotation axis 83 may vary depending upon dimensional variations in tolerances in the various parts and on wear which might occur in the components, the resiliency of the cam 85 permits deflection thereof and generates a constant upward biasing force on the lever 54. If tolerances vary or wear occurs, the cam 85 is constantly biased upwardly into contact with the lever 54 in the active position of FIG. 13 so as to accommodate such dimensional variations.

The inventive cam body 79 furthermore includes a fixed radial projection 99 which generally projects in the same radial direction as the distal end 91 but is spaced axially from the distal cam section 91. The radial projection 99 is adapted to axially contact an inside face of the cabinet housing 11 as generally illustrated in FIG. 13 so as to draw the drawer 12 inwardly to a fully closed position and also help retain the drawer 12 in this position.

With reference to FIGS. 11–14, the cam lock assembly 45 according to the invention is installed on the front wall 33 of the topmost drawer 12 so that the cam 85 of cam member 79 is oriented generally horizontally in the unlocked position (FIGS. 12 and 14), and generally vertically in the locked position (FIGS. 11 and 13).

In operation, when it is desirable to lock all of the drawers 12 of the storage cabinet 10 according to the invention, the user inserts a key into the actuator 121 (not shown) of cam lock assembly 45 and turns the key clockwise to cause rotation of the cam 85 in a clockwise direction. As the cam 85 translates upwardly, the camming surface 92 thereof engages the actuator portion 54 of horizontal drive element 42 and lifts same upwardly causing rotation of drive element 42 relative to and within guide channel 44. This upward lifting of the actuator portion 54 and rotation of element 42 and the second leg 56 thereof applies an upwardly directed force on vertical locking bar 41 to lift same into its uppermost position relative to side wall 13, so that the flanges 52 thereof engage within correspondingly located recesses defined in the individual drawers 12. The engagement of the flanges 52 of locking bar 41 with the drawers 12 prevents same from being opened.

To unlock the drawers 12, the user turns the key in a counterclockwise direction, which causes rotation of the cam body 79 counterclockwise. As the cam 85 translates circumferentially downwardly, the actuator portion 54 of locking bar 42 rotates, and the vertical locking bar 41 under its own weight returns to the unlocked or lowermost position to disengage the flanges 52 from the drawers 12 and allow same to be opened.

The ability of the cam 85 to deflect avoids the need for readjustment of the position of cam member 79 relative to the horizontal locking bar 42. Further, the cam body 79 remains stationary relative to the rotation axis 83 to thereby avoid undesirable creep. Accordingly, the cam body 79 pursuant to the present invention deflects and self-adjusts every time the cam member 79 is moved into the active position, which avoids the need for positional readjustment of the cam member 79.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A furniture unit comprising:

a housing defining a hollow interior which opens forwardly through an open front end;

a storable component mounted on said housing for movement between a stored position wherein said storable component is disposed within said hollow interior and a use position wherein said storable component projects outwardly from said hollow interior; and a locking arrangement which locks said storable component in said stored position, said locking arrangement including a first locking element movably supported on said housing which is movable between a locked position wherein said storable component is locked in said stored position and an unlocked position wherein said storable component is movable within said housing, said locking arrangement including a rotatable cam body which cooperates with said first locking element and is rotatable about a rotation axis between an active position which biases said first locking element to said locked position and an inactive position which permits said first locking element to move to said unlocked position, said locking arrangement including an actuator having said cam body mounted thereon and adapted to effect rotation of said cam member about said rotation axis, said cam body having a cam projecting generally radially outwardly from said cam body for contacting engagement with said first locking element, said cam body being rotatable about said rotation axis and said cam being resiliently deflectable to accommodate variations in distance between said rotation axis and said first locking element.

2. The furniture unit according to claim 1, wherein said actuator and said cam body are fixed on said storable component.

3. The furniture unit according to claim 2, wherein said storable component is a drawer.

4. The furniture unit according to claim 1, wherein said cam moves circumferentially about said rotation axis during movement from said inactive position to said active position, said cam including a camming surface which faces circumferentially towards said first locking element for contact therewith and deflection of said cam during rotation of said cam member from said inactive position to said active position.

5. The furniture unit according to claim 4, wherein said camming surface is arcuate and curves circumferentially away from said first locking element.

6. The furniture unit according to claim 1, wherein said cam has an arcuate configuration and is resiliently deflectable radially inwardly toward said rotation axis.

7. The furniture unit according to claim 1, wherein said actuator and said cam body are mounted on said storable component and said cam body includes a fixed radial projection which rotates into engagement with said housing to prevent movement of said storable component within said housing.

8. The furniture unit according to claim 1, wherein said cam is cantilevered from said cam body and has a free end portion which contacts and displaces said first locking element when said cam body is in said active position.

9. The furniture unit according to claim 1, wherein said cam extends radially between a proximal end fixed on said cam body and a free distal end, said cam bending radially during resilient deflection thereof to change the radial distance between said free end and said rotation axis.

10. The furniture unit according to claim 1, wherein said cam extends circumferentially to define a radial space between an inner surface of said cam and an opposing outer surface of said cam body.

11. A storage cabinet comprising:

a housing defining a generally hollow interior which opens forwardly through an open front end;

a drawer mounted within said hollow interior and being slidable into and out of said open front end between closed position within said hollow interior and an open position projecting outwardly from said open front end; and a locking arrangement associated with said drawer, said locking arrangement including an actuator and a cam member mounted on said drawer, and a locking element which cooperates with and is moved by said cam member between a locking position which prevents movement of said drawer within said hollow interior and an unlocked position which permits movement of said drawer, said actuator defining a fixed rotation axis and said cam member being connected to said actuator for rotation about said rotation axis, said cam member being non-movable radially relative to said rotation axis, said cam member including a cam which projects radially outwardly away from said rotation axis for engagement with said locking element to effect movement of said locking element between said locked position and said unlocked position during rotation of said cam member by said actuator, said cam being resiliently deflectable radially relative to said rotation axis.

12. The storage cabinet according to claim 11, wherein said actuator and said cam member have a cooperating projection and aperture which prevents radial displacement of said cam member relative to said rotation axis.

13. The storage cabinet according to claim 12, wherein a fastener engages said projection such that said cam member is slidably fitted onto said actuator and non-movably affixed in position.

14. The storage cabinet according to claim 11, wherein said cam member includes a fixed radial projection which projects radially outwardly axially adjacent to said cam, said fixed radial projection cooperating with said housing when said locking element is in said locked position to prevent movement of said drawer relative to said housing.

15. The storage cabinet according to claim 11, wherein said locking element is movably supported on said housing.

16. The storage cabinet according to claim 15, wherein said locking element is rotatable about a horizontal rotation axis which extends transverse to said rotation axis about which said cam member rotates, said locking element including a radial lever projecting radially outwardly therefrom which is rotated about said horizontal rotation axis by rotating movement of said cam member.

17. The storage cabinet according to claim 11, wherein said locking element includes a portion thereof cooperating with said cam of said cam member wherein rotation of said cam member effects vertical displacement of said cooperating portion of said locking element.

18. A storage cabinet comprising:

a housing defining a generally hollow interior which opens forwardly through an open side;

a drawer mounted within said hollow interior and being movable into and out of said open side between a retracted position within said hollow interior and an extended position projecting outwardly from said open side; and a locking arrangement associated with said drawer, said locking arrangement including an actuator and a cam member mounted on said drawer and including a locking element which cooperates with and is moved by said cam member between a locking position which prevents movement of said drawer within said hollow interior and an unlocked position which permits movement of said drawer, said actuator defining a fixed rotation axis and said cam member being connected to said actuator for rotation about said rotation axis, wherein said cam member is radially non-movable relative to said rotation axis, said cam member including a cam which projects radially outwardly away from said rotation axis and has a cam surface engaged with said locking element to effect movement of said locking element between said locked position and said unlocked position during rotation of said cans member by said actuator, said cam being resiliently deflectable from an initial position radially inwardly to a deflected position by rotation of said cam member into contacting engagement with said locking element wherein the distance between the cam surface and said rotation axis changes during deflection of said cam from said initial position to said deflected position.

19. The storage cabinet according to claim 18, wherein said cam extends radially and circumferentially relative to said rotation axis to define an inclined camming surface which contacts said locking element.

20. The storage cabinet according to claim 19, wherein said camming surface is arcuate.

21. The storage cabinet according to claim 18, wherein said cam restores itself from said deflected position to said initial position upon movement of said cam member from said active position back to said inactive position.

22. The storage cabinet according to claim 21, wherein said cam member is formed as a one-piece molded part.

23. The storage cabinet according to claim 22, wherein rotation of said cam member moves said cam generally circumferentially to bias said locking element vertically upwardly.

24. The storage cabinet according to claim 18, wherein said cam member is secured to said actuator so as to be fixed radially relative to said rotation axis.

* * * * *

UNITED STATES PATENT AND TRADEMARK OFFICE

CERTIFICATE OF CORRECTION

PATENT NO. : 6,890,043 B2
DATED : May 10, 2005
INVENTOR(S) : Richard G. Haworth et al.

It is certified that error appears in the above-identified patent and that said Letters Patent is hereby corrected as shown below:

Column 10,
Line 38, change "cans member" to -- cam member --.

Signed and Sealed this

Thirteenth Day of September, 2005

JON W. DUDAS
*Director of the United States Patent and Trademark Office*